US006335687B1

(12) United States Patent
Terashima et al.

(10) Patent No.: US 6,335,687 B1
(45) Date of Patent: Jan. 1, 2002

(54) LOCKED-IN PERSON SAVING APPARATUS

(75) Inventors: Noriaki Terashima, Okazaki; Yoshihisa Sato, Nagoya; Hitoshi Ouchi, Chiryu; Akihiro Nakamura, Okazaki, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/649,821

(22) Filed: Aug. 28, 2000

(30) Foreign Application Priority Data

Aug. 31, 1999 (JP) ..... 11-245942
Aug. 31, 1999 (JP) ..... 11-245943

(51) Int. Cl.[7] ..... G08B 23/00

(52) U.S. Cl. ..... 340/573.1; 340/573.4; 340/425.5; 340/426

(58) Field of Search ..... 340/573.1, 573.4, 340/425.5, 426, 589, 584, 438, 449; 180/271; 362/496; 296/76, 336

(56) References Cited

U.S. PATENT DOCUMENTS 5,793,291 A * 8/1998 Thornton ..... 340/573
5,859,479 A * 1/1999 David ..... 307/10.8
5,949,340 A * 9/1999 Rossi ..... 340/573.1
6,018,292 A * 1/2000 Penny, Jr. ..... 340/426
6,091,322 A * 7/2000 Ang et al. ..... 340/425.5
6,130,614 A * 10/2000 Miller et al. ..... 340/573.4
6,166,625 A * 12/2000 Teowee et al. ..... 340/426

* cited by examiner

*Primary Examiner*—John Tweel
(74) *Attorney, Agent, or Firm*—Law Office of David G. Posz

(57) ABSTRACT

A trunk locked-in person saving apparatus without using a mechanical lever. The trunk locked-in person saving apparatus includes: a pyroelectric sensor for detecting behavior of a person who is accidentally locked in a trunk; a detection apparatus for detecting a fact that a person is locked in the trunk based on a detection signal from the pyroelectric sensor; and a trunk opener for releasing a latch condition of the trunk. When the detection apparatus detects that a person is locked in the trunk, the detection apparatus controls the trunk opener to release the latch condition of the trunk.

22 Claims, 15 Drawing Sheets

LOCKED-IN PERSON SAVING APPARATUS

CROSS REFERENCE TO RELATED APPLICATION

This application is based upon Japanese Patent Application Nos. Hei. 11-245942 filed on Aug. 31, 1999, and Hei. 11-245943 filed on Aug. 31, 1999, the contents of which are incorporated herein by reference.

BACKGROUND OF THE INVENTION

1. Field of the Invention

This invention relates to locked-in person saving apparatuses, and particular to a locked-in person saving apparatus for saving a person who is locked in a vehicular trunk.

2. Related Art

Conventionally, when a person is accidentally locked in a vehicular trunk, the person may not be able to escape from the trunk. Therefore, a countermeasure in which a lever linked with a latch mechanism of the trunk is provided to release a latch condition from inside of the trunk has been proposed.

However, in the latch mechanism having the lever in the above, a little child or an infant cannot operate this lever. Moreover, when a person is locked in the trunk, the person may panic so that he/she may not be able to calmly operate the lever.

SUMMARY OF THE INVENTION

This invention has been conceived in view of the background thus far described and its first object is to provide a locked-in person saving apparatus for saving a person who is locked in a closed space.

Its second object is to provide a locked-in person saving apparatus for saving a person who is locked in a vehicular trunk without using a mechanical lever.

According to a first aspect of the present invention, a detector detects whether a person is locked in a closed space. A closed-space controller outputs a lock release signal when the detector detects that a person is locked in the closed space. A lock releaser releases a lock condition of the closed space in response to the lock release signal from the closed-space controller. According to this structure, since the lock releaser releases the lock condition of the closed space (trunk) by being controlled by the closed-space controller (trunk controller), a person who is locked in a closed space can be saved without using a mechanical lever.

According to a second aspect of the present invention, an operation controller outputs a signal for saving a person locked in a trunk of a vehicle. A trunk open/close switch connected between a power source and the operation controller, the trunk open/close switch being turned on when the trunk is closed and being turned off when the trunk is opened. A power supply unit supplies a power from the power source to the operation controller through the trunk open/close switch only for a predetermined time after the trunk is closed. According to this structure, the saving process to be executed by the control circuit is started or stopped in response to the start or stop of the power supply to the control circuit, instead of using a trunk open/close signal from a trunk lighting lamp. Therefore, it does not need a harness for transmitting the trunk open/close signal from the trunk lighting lamp, and it can reduce the number of the harnesses.

BRIEF DESCRIPTION OF THE DRAWINGS

These and another objects, features and characteristics of the present invention will be appreciated from a study of the following detailed description, the appended claims, and drawings, all of which form parts of this application. In the drawings, same portions or corresponding portions are put the same numerals each other to eliminate redundant explanation. In the drawings:

DESCRIPTION OF THE PREFERRED EMBODIMENTS (First embodiment)

Figure 1:
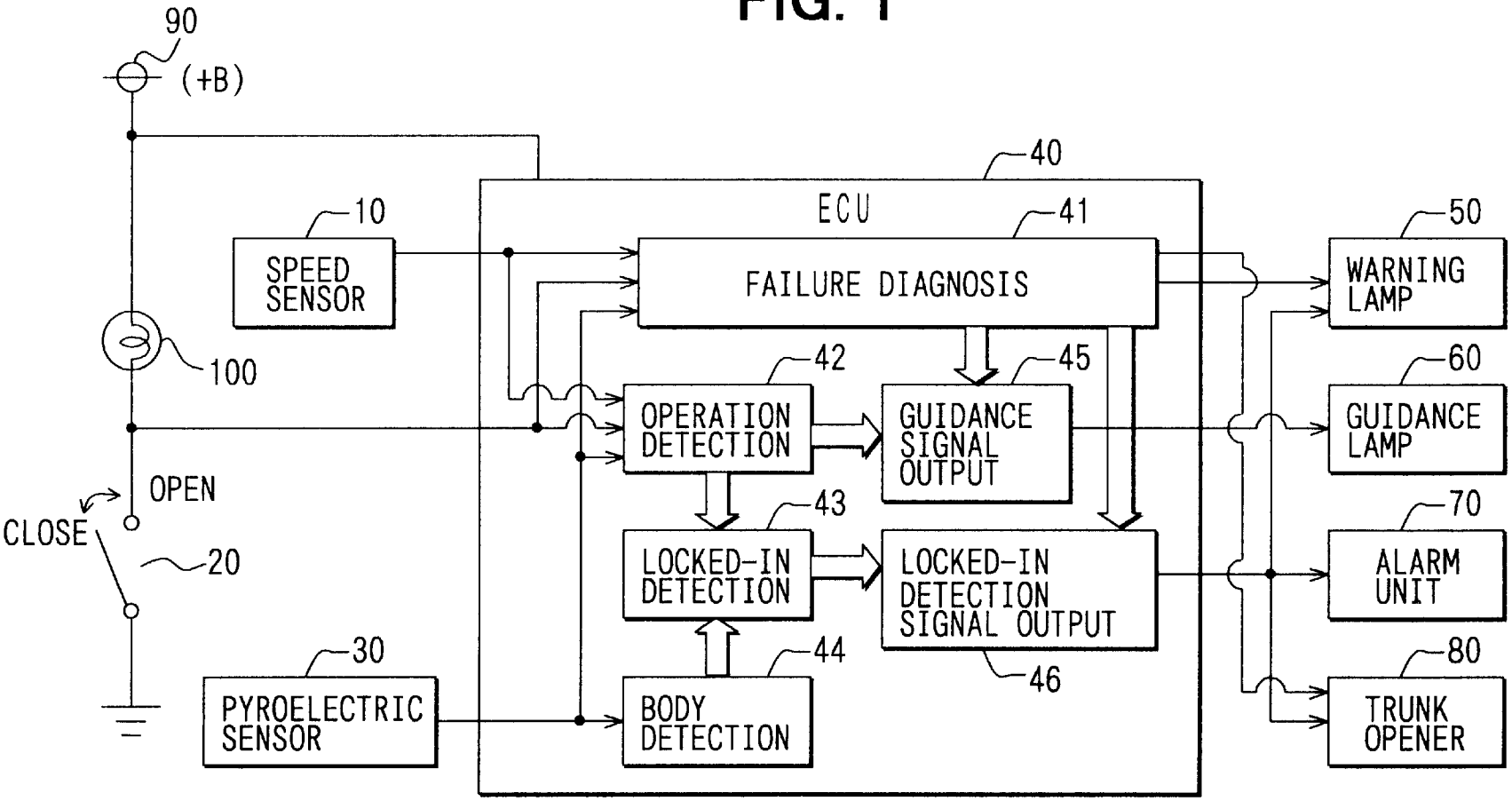
FIG. 1 is an electric block diagram illustrating a trunk locked-in person saving apparatus of a first embodiment according to the present invention.
Figure 2:
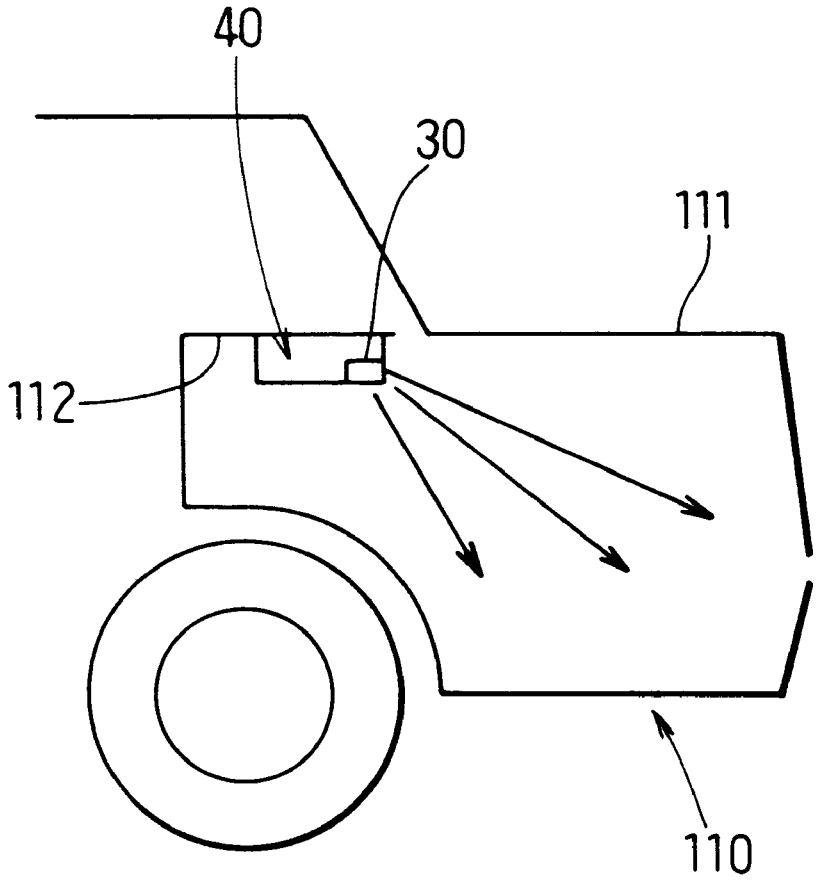
FIG. 2 is a schematic diagram illustrating a position of a pyroelectric sensor in FIG. 1.
Figure 2:
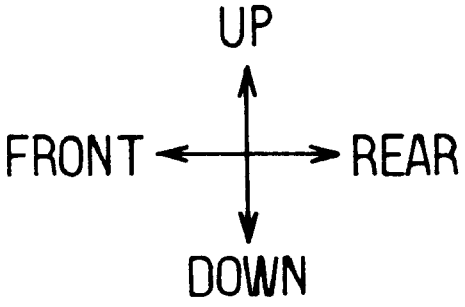

FIGS. 1 and 2 shows a first embodiment in which the present invention is applied to a trunk locked-in person saving apparatus. FIG. 1 shows a block diagram illustrating an electric circuit structure of the trunk locked-in saving apparatus; and FIG. 2 shows a schematic diagram illustrating a mounting position of the trunk locked-in person saving apparatus.

As shown in FIG. 1, the trunk locked-in person saving apparatus is provided with a speed sensor 10, a truck open/close switch 20, a pyroelectric sensor 30, a detection apparatus 40, a warning lamp 50, a guidance lamp 60, an alarm unit 70 and a trunk opener 80.

The speed sensor 10 outputs a vehicle speed signal to the detection apparatus 40 based on a speed of the vehicle.

The trunk open/close switch 20 is connected between a battery (+B) 90 and a ground. The trunk open/close switch 20 is turned on when a trunk is opened, and is turned off when the trunk is closed. As a result, a trunk open/close switch signal is outputted from a one terminal (at a side of battery 90) of the trunk open/close switch in response to an opening or a closing of the trunk (trunk lid).

Here, a trunk lighting lamp 100 for lighting an inside of the trunk is connected between the battery 90 and the trunk open/close switch 20. The trunk lighting lamp 100 is turned on to light inside of the trunk when the trunk is opened, and is turned off when the trunk is closed. The trunk lighting lamp 100 is arranged near the pyroelectric sensor 30, and is used for a failure detection of the pyroelectric sensor 30 as described later.

The pyroelectric sensor 30 outputs a detection signal in response to temperature changes per unit time (an amount of change of received infrared radiation) in the trunk. As a result, the pyroelectric sensor 30 detects movements of object having a predetermined temperature in the trunk, and outputs the detection signal to the detection apparatus 40. In other words, the pyroelectric sensor 30 senses the behavior of a person who is locked in the trunk.

Here, as shown in FIG. 2, the pyroelectric sensor 30 is contained in the trunk (hereinafter, called as "trunk 110") with the detection apparatus 40, and is positioned on a upper wall 112 in the front of a trunk lid 111.

As shown in FIG. 1, the detection apparatus (ECU) 40 is provided with a failure diagnosis portion 41, an operation detection portion 42, a locked-in detection portion 43, a body detection portion 44, a guidance signal output portion 45 and a locked-in detection signal output portion 46. The detection apparatus 40 executes a locked-in person saving process for saving the person who is locked in the trunk 110.

The failure diagnosis portion 41 detects a failure of the pyroelectric sensor 30. The operation detection portion 42 judges whether a locked-in prevention process for the person in the trunk 110 is executed or not. The locked-in detection portion 43 judges whether a person is locked in the trunk 110 or not. The body detection portion 44 detects an existence of a person in the trunk 110.

The guidance signal output portion 45 turns on the guidance lamp 60 in response to decisions of the failure diagnosis portion 41 and the operation detection portion 42. The locked-in detection signal output portion 46 controls the warning lamp 50, the alarm unit 70 and the trunk opener 80 in response to the decisions of the failure diagnosis portion 41 and the locked-in detection portion 43. The detection apparatus 40 is made up of a microcomputer or the like. Operation of the detection apparatus 40 will be described later.

The warning lamp 50 is a display panel provided near an instrument panel of the vehicle, and is controlled by the detection apparatus 40. The warning lamp 50 is for alarming the fact that a person is locked in the trunk 110.

The guidance lamp 60 is made up of a light emitting diode provided near the pyroelectric sensor 30, and is controlled by the detection apparatus 40, so that the guidance lamp 60 guides the person locked in the trunk toward the pyroelectric sensor 30. Here, the guidance lamp 60 has an infrared ray shield filter. As a result, the detection signal from the pyroelectric sensor 30 is not influenced by emitting light from the guidance lamp 60.

Here, the trunk lighting lamp 100 may be used as the guidance light without using additional guidance lamp 60. In this case, it is preferable to provide the trunk lighting lamp 100 near the pyroelectric sensor 30; and it is preferable that the detection apparatus 40 turns on the trunk lighting lamp 100 to guide the person locked in the trunk toward the pyroelectric sensor 30. Here, the trunk lighting lamp 100 may be integrated with the pyroelectric sensor 30 and the detection apparatus.

The alarm unit 70 is controlled by the detection apparatus 40, and outputs an alarm by way of sound. The trunk opener (latch release mechanism) 80 is actuated by the detection apparatus 40 to release a latch condition of the trunk 110.

Hereinafter, processes of the detection apparatus 40 (process for saving the person locked in the trunk 110) will be explained with reference to FIGS. 3 to 6. The detection apparatus 40 performs these processes based on a flowchart shown in FIG. 3.

Figure 4:
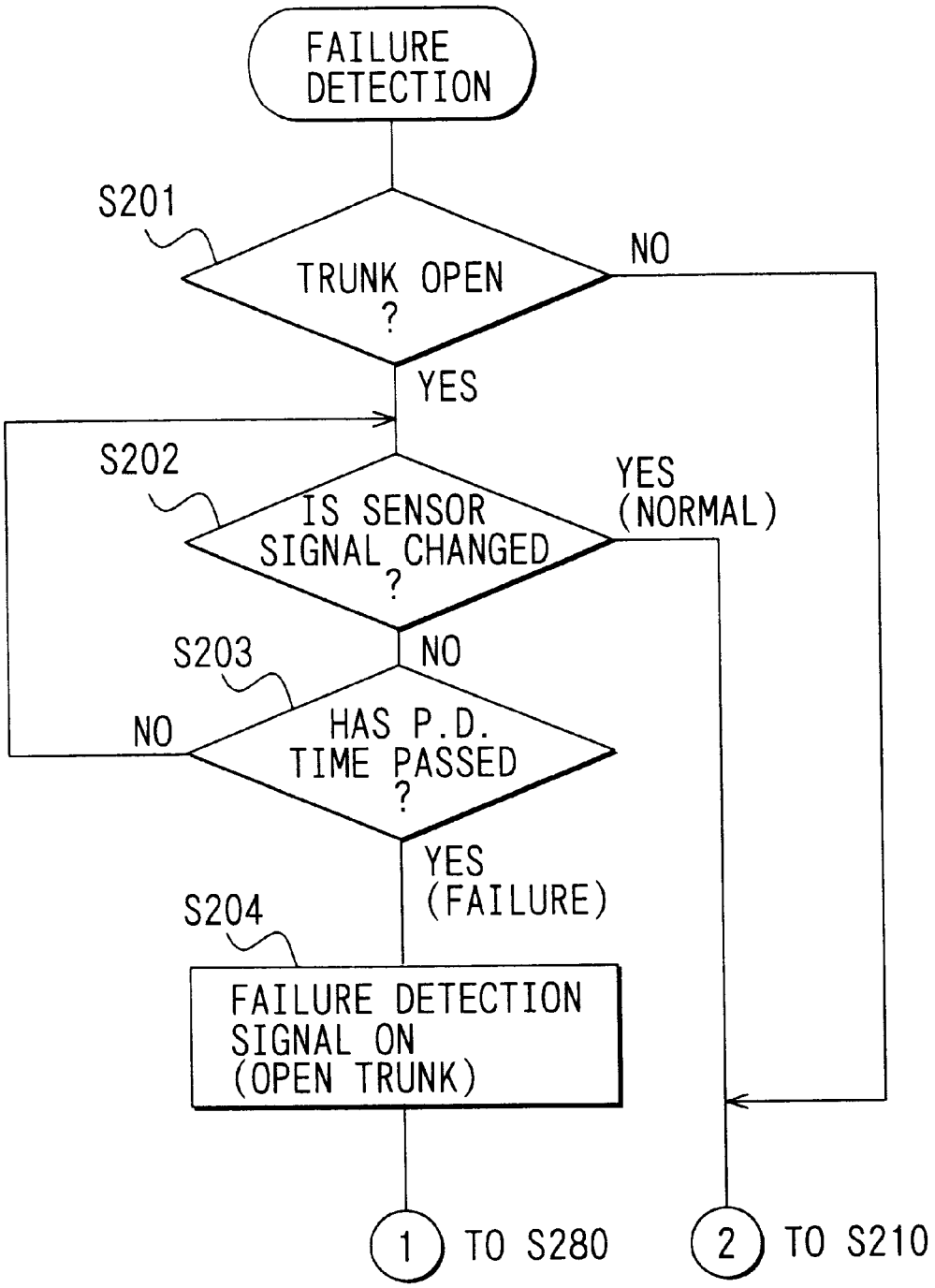
FIG. 4 is a flowchart illustrating a failure detection step S200 in FIG. 3 in detail.

At first, as step S200, the detection apparatus 40 judges whether the pyroelectric sensor is in a failure condition (out of order) or not. In detail, as shown in FIG. 4, the detection apparatus 40 judges whether the trunk 10 is opened or not in response to the trunk open/close switch signal from the trunk open/close switch 20 (step S201). When the trunk 110 is opened, the detection apparatus 40 continues judging for a predetermined time whether the detection signal from the pyroelectric sensor 30 is changed or not (steps S202 and S203).

Here, when the trunk 110 is opened, the trunk lighting lamp 100 is turned on. Therefore, when the pyroelectric sensor 30 is normal, the detection signal from the pyroelectric sensor 30 is changed depending on a turning on of the trunk lighting lamp 100. As a result, the detection apparatus 40 can detect whether the pyroelectric sensor 30 is in the failure condition (in other words, the pyroelectric sensor is broken down or not) by detecting whether the detection signal from the pyroelectric sensor 30 has been changed or not.

Next, when the detection signal from the pyroelectric sensor 30 has not been changed within the predetermined time at steps S202 and S203, the detection apparatus 40 determines that the pyroelectric sensor 30 is in the failure condition (broken down), and then outputs a failure detection signal to the trunk opener 80 (step S204).

Therefore, the trunk opener 80 receives the failure detection signal, and holds the latch release condition of the trunk 110. Thus, it can prohibit the trunk 110 from becoming the latch condition by manual operation.

When the detection signal from the pyroelectric sensor 30 has been changed at step 202, the detection apparatus 40 determines that the pyroelectric sensor 30 is in a normal condition. In this case, the detection apparatus 40 moves to step S210 shown in FIG. 3 to judge whether an operation condition for operating a body detection in the trunk 110 is met or not.

Figure 5:
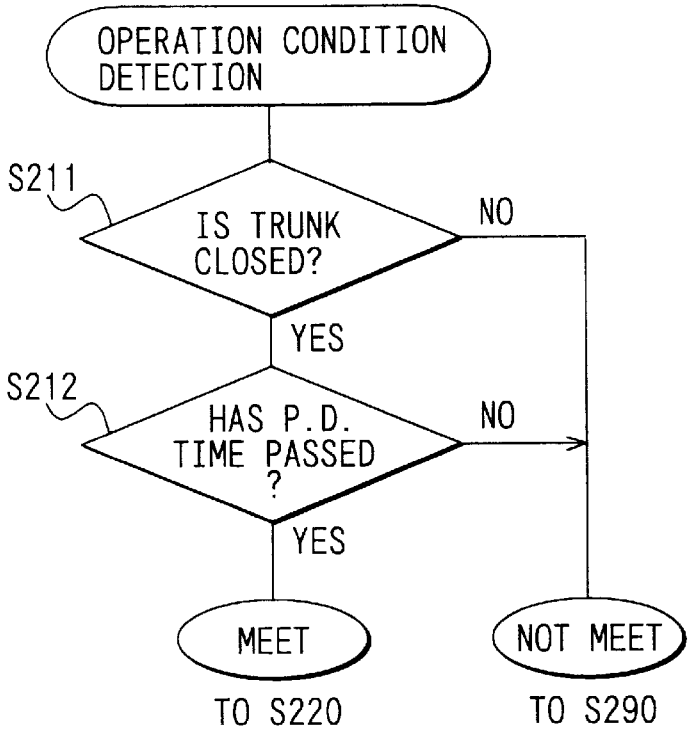
FIG. 5 is a flowchart illustrating an operation condition detection step S210 in FIG. 3 in detail.

In detail, as shown in FIG. 5, the detection apparatus 40 judges whether the trunk 110 is opened or not (step S211). When the trunk 110 is closed, the detection apparatus 40 moves to step 212 to judge whether a predetermined time has passed after the trunk 110 is closed (step S212). When the predetermined time has passed after the trunk 110 is closed, the operation condition meets.

Here, when the predetermined time has not passed after the trunk 110 is closed at step S212, the operation condition does not meet. Furthermore, when the trunk 110 is opened at step S211, the operation condition also does not meet.

Figure 6:
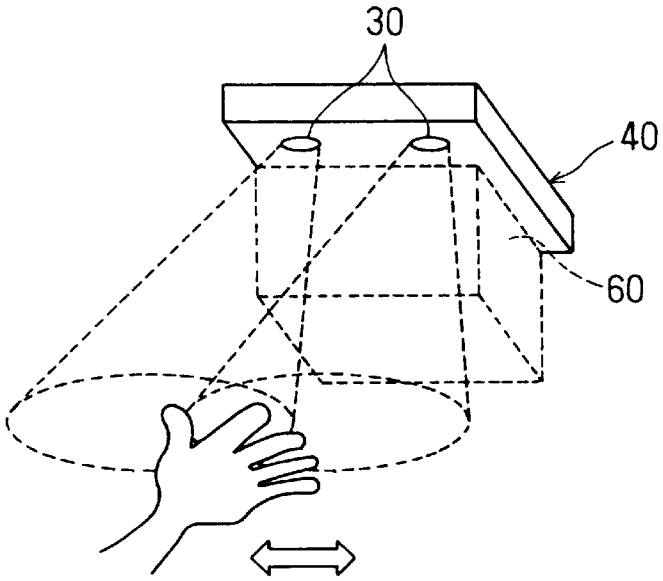
FIG. 6 is a diagram illustrating an operation of the pyroelectric sensor.

Next, when the operation condition meets in the judgment in the above, the detection apparatus 40 turns on the guidance lamp 60 (step S220). Thus, when the person is locked in the trunk 110, as shown in FIG. 6, the guidance lamp 60 attracts the attention of the person, and then the person moves a part of his/her body (FIG. 6 shows a hand) to the guidance lamp 60 and the pyroelectric sensor 30. As a result, the person's movement is partly detected by the pyroelectric sensor 30.

Next, the detection apparatus 40 compares the detection signal from the pyroelectric sensor 30 with a threshold value (step S230). When the detection signal from the pyroelectric sensor 30 is equal to or more than the threshold value (detection signal≧threshold value), the detection apparatus moves to step S240 to detect whether a condition, in which the detection signal from the pyroelectric sensor 30 is larger than the threshold value, continues for a predetermined time or not. Here, when the condition continues for the predetermined time, the detection apparatus 40 determines that a person is locked in the trunk 110, and the detection apparatus 40 moves to step S250 to outputs a locked-in detection signal to the warning lamp 50, the alarm unit 70 and the trunk opener 80.

Therefore, the warning lamp 50 is turned on when it receives the locked-in detection signal. The alarm unit 70 outputs alarm by way of sound when it receives the locked-in detection signal. The trunk opener releases the latch condition of the trunk 110 when it receives the locked-in detection signal.

Next, the detection apparatus 40 judges whether the trunk 110 is opened or not based on the trunk open/close switch signal from the trunk open/close switch 20 (step S260). When the trunk 110 is opened, the detection apparatus 40 moves to step S270 to terminate the output of the locked-in detection signal. As a result, the warning lamp 50 is turned off, and the alarm unit 70 terminates the alarm. Here, when the pyroelectric sensor 30 is detected as failure at step S200, the detection apparatus 40 turns on the warning lamp 50 (step S280), and turns off the guidance lamp (step S290).

According to the structure in the above, when the detection apparatus 40 detects that a person is locked in the trunk 40 based on the detection signal from the pyroelectric sensor 30, the detection apparatus 40 makes the trunk opener 80 release the latch condition of the trunk 110. Thus, even if a person is accidentally locked in the trunk, the person can be saved from the trunk.

Here, when the detection apparatus 40 detects that a person is locked in the trunk 40 based on the detection signal from the pyroelectric sensor 30, the detection apparatus 40 makes the alarm unit 70 output the alarm. Thus, this system can also be used as part of a trunk anti-thief device.

Furthermore, in order to judge whether a person is locked in the trunk 110 or not, the detection apparatus 40 judges whether the condition, in which the detection signal from the pyroelectric sensor 30 is larger than the threshold value, continues for a predetermined time or not. As a result, the detection apparatus can precisely detect whether a person is locked in the trunk 110 or not.

The detection apparatus guides the person who is locked in the trunk 110 so that he/she can approaches a part of his/her body the pyroelectric sensor 30 by turning on the guidance lamp 60, the person in the trunk can approach the pyroelectric sensor 30 without fail. As a result, a person locked in the trunk can be saved without fail.

The detection apparatus 40 judges whether the pyroelectric sensor 30 is in the failure condition or not when the trunk 110 is opened. Therefore, the locked-in of a person can be prevented in advance even when the trunk locked-in person saving apparatus is out of order.

Here, the detection apparatus 40 utilizes light from the trunk lighting lamp 100, when it detects whether the pyroelectric sensor 30 is in the failure condition or not. Therefore, the trunk locked-in person saving apparatus does not need additional parts.

Since the pyroelectric sensor 30 is contained in the trunk 110 and is positioned on the upper wall 112 in the front of the trunk lid 111, it can prevent the pyroelectric sensor 30 from being influenced by light (solar light) from outside.

Here, since the pyroelectric sensor 30 is positioned on the upper wall 112 in the front of the trunk lid 111 with the detection apparatus 40, it can prevent the pyroelectric sensor 30 from being influenced by vibration due to opening or closing the trunk 110.

Since the lock-in of the person in the trunk 110 occurs after the trunk 110 is closed from its opening condition, the detection apparatus 40 of this embodiment performs a body detection process only during a predetermined period after the trunk 110 is closed. As a result, it can reduce a chance of failure of the detection apparatus 40 and can reduce power consumption of the detection apparatus. Here, the detection apparatus 40 may start the body detection process in the trunk 110 when illumination in the trunk 110 is changed from a bright condition to a dark condition, instead of the trunk open/close switch signal from the trunk open/close switch 20. Furthermore, the detection apparatus 40 may perform the body detection process only within a predetermined period from a time when an engine or an ignition switch is turned off.

In the embodiment in the above, the pyroelectric sensor 30 is used to detect the person's body in the trunk 110. However, an infrared ray image sensor or the like may be used to detect the person's body in the trunk 110. Since the infrared ray image sensor can detect temperature of body, the detection apparatus 40 can detect the existence of the person in the trunk 110 based on the detected temperature.

Moreover, a touch sensor such as a touch switch, a membrane switch, an electrostatic sensor or the like may be used. In this case, the existence of the body in the trunk 110 can be detected when a part of the body contacts with the touch sensor in the trunk 110. Furthermore, a ultrasonic waves sensor or a photoelectric switch may be used to detect the movement of the person in the trunk 110 to detect the existence of the person in the trunk 110.

In addition, a gas sensor such as an oxygen ($O_2$) sensor may be used to detect a concentration of gas such as oxygen in the trunk 110. In this case, the existence of the person in the trunk 110 can be detected by detecting changes of the concentration of the gas (oxygen). A combination of two or more of the pyroelectric sensor 30, the infrared ray image sensor, the touch switch, the membrane switch, the photoelectric sensor, and the oxygen sensor may be used to detect the existence of the person in the trunk 110.

In this embodiment, the fact that a person is locked in the trunk 110 is sounded externally by outputting sound from the alarm unit 70. However, Klaxon (or buzzer, chime), or radio communication means such as handy phone, personal handy phone and a May Day system may also be used. Here, the May Day system is a system for, when a vehicle is in an "abnormal condition", informing the "abnormal condition" to a base station via radio communication to call for help.

The alarm unit 70 may use alarm by way of light instead of the sound. In this case, one of lamps which has originally provided to a vehicle such as headlamps, position lamps, small lights, fog lamps, tail lamps or stop lamps may be turned on (be flashed).

In this embodiment, the trunk lighting lamp 100 is used to detect the failure condition of the pyroelectric sensor 30;

however, a solar radiation or the guidance lamp 60 may be used instead. Here, when the guidance lamp 60 is used, the guidance lamp 60 is controlled so that it is turned on when the trunk 110 is opened.

In this embodiment, the failure detection of the pyroelectric sensor 30 is performed when the trunk 110 is opened; however, the failure detection thereof may be performed when an ignition switch is turned on. In this case, the trunk lighting lamp 100 is controlled so that it is turned on when the ignition switch is turned on. Furthermore, the failure detection may be performed when the ignition switch is turned off.

(Second embodiment)

In the first embodiment, when the detection apparatus 40 detects the fact that a person is locked in the trunk 110, the detection apparatus 40 detects whether the condition, in which the detection signal from the pyroelectric sensor 30 is larger than the threshold value, continues for the predetermined time or not. However, this locked-in detection may be performed by comparing two different threshold values (hereinafter, called as threshold value a, b) and the detection signal from the pyroelectric sensor 30.

Here, the sensor threshold a is set to a level that is lower than the threshold b and the level of the detection signal from the pyroelectric sensor 30 increases as an amount of temperature changes of the target object per unit time increases. Therefore, the threshold a is used for detecting a small amount of temperature changes compared to that of the threshold b. In other words, the threshold a is determined so that the sensor sensibility becomes more sensitive compared to the threshold b.

Figure 3:
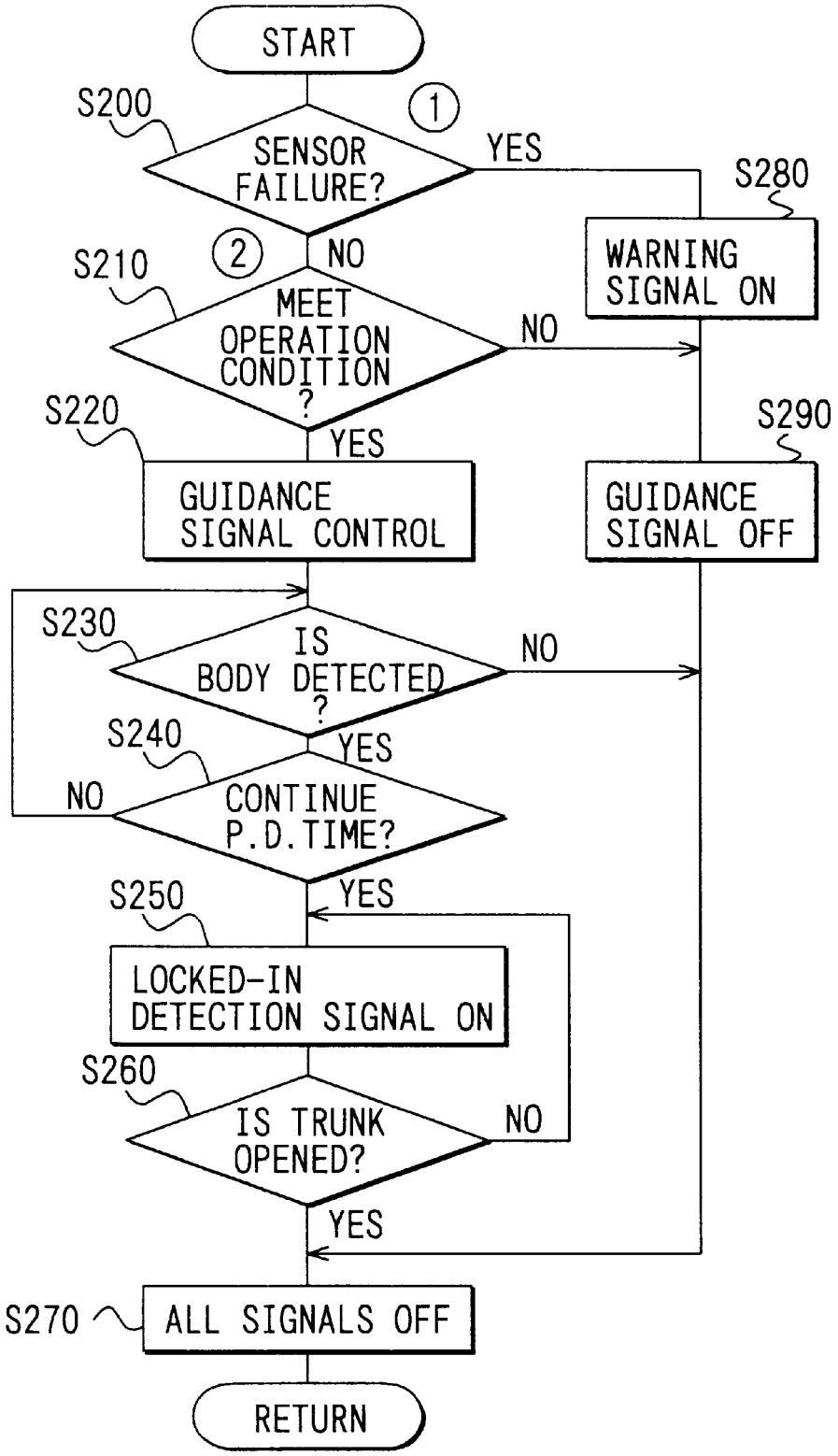
FIG. 3 is a flowchart illustrating an operation of a detection apparatus in FIG. 1.
Figure 7:
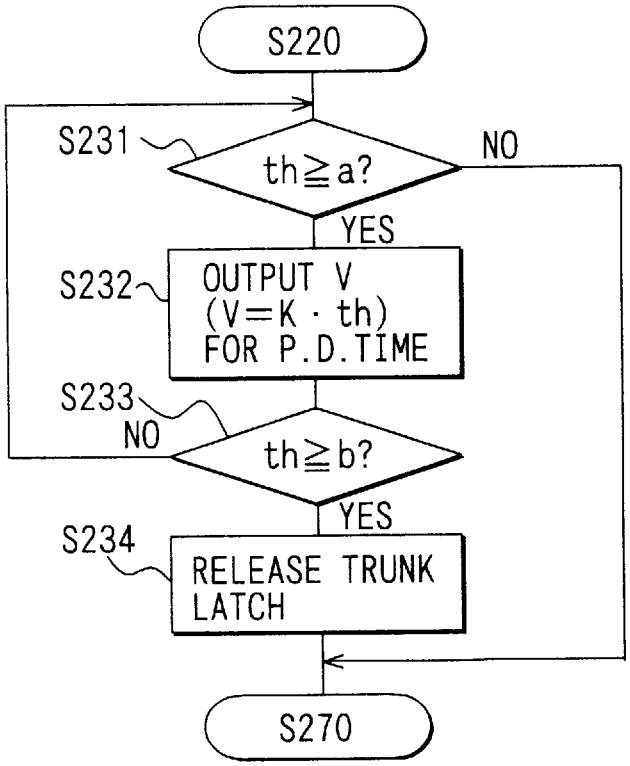
FIG. 7 is a flowchart illustrating an operation of a detection apparatus of a second embodiment according to the present invention.

In this second embodiment, steps S230–S260 shown in FIG. 3 are replaced with steps S231–S234 shown in FIG. 7. The detection apparatus 40 shown in FIG. 1 executes several processes based on flowcharts shown in FIGS. 3 and 7 (steps S230 and S240 in FIG. 3 are replaced with steps in FIG. 7).

Hereinafter, the operation of the detection apparatus 40 of this embodiment will be explained with reference to FIG. 7.

At first, the detection apparatus 40 detects whether a detection signal th from the pyroelectric sensor 30 is larger than the threshold a (step S231). When the detection signal th is larger than the threshold a (detection signal th≧threshold a), the detection apparatus 40 moves to step S232. At step S232, the detection apparatus 40 controls the alarm unit 70 to output the alarm by way of sound for a predetermined time. Here, the alarm output (loudness of the sound) changes in proportion to the detection signal th from the pyroelectric sensor 30 (alarm output V=detection signal th×K; Here, K is a positive constant value).

Next, the detection apparatus 40 detects whether the detection signal th from the pyroelectric sensor 30 is larger than the threshold b (step S233). When the detection signal th is larger than the threshold b (detection signal th≧threshold b), the detection apparatus 40 moves to step S234 to output the locked-in detection signal to the trunk opener 80. As a result, the trunk opener 80 releases the latch condition of the trunk 110 in response to the locked-in detection signal. In this time, the warning lamp 50 may be turned on.

Here, the detection apparatus 40 controls the alarm unit 70 to output the alarm by way of sound when the When the detection signal th is larger than the threshold a. As a result, the alarm unit 70 outputs the alarm by way of sound in advance to control the trunk opener 80 with the detection apparatus 40. Therefore, when trunk 110 is opened by irregular operation, the alarm unit 70 can be activated. Hence, it can effectively prevent baggage or luggage in the trunk 110 from being stolen.

In this embodiment, the detection apparatus 40 detects whether the latch condition of the trunk 110 is to be released or not based on the comparison of the detection signal from the pyroelectric sensor 30 and the threshold voltages a and b. However, two different pyroelectric sensors (pyroelectric sensors 31 and 32) each of which has a different sensitivity may be used, and the detection apparatus 40 may detect whether the latch condition of the trunk 110 is to be released or not based on the detection result of the pyroelectric sensors 31 and 32, as shown in FIG. 8.

Figure 8:
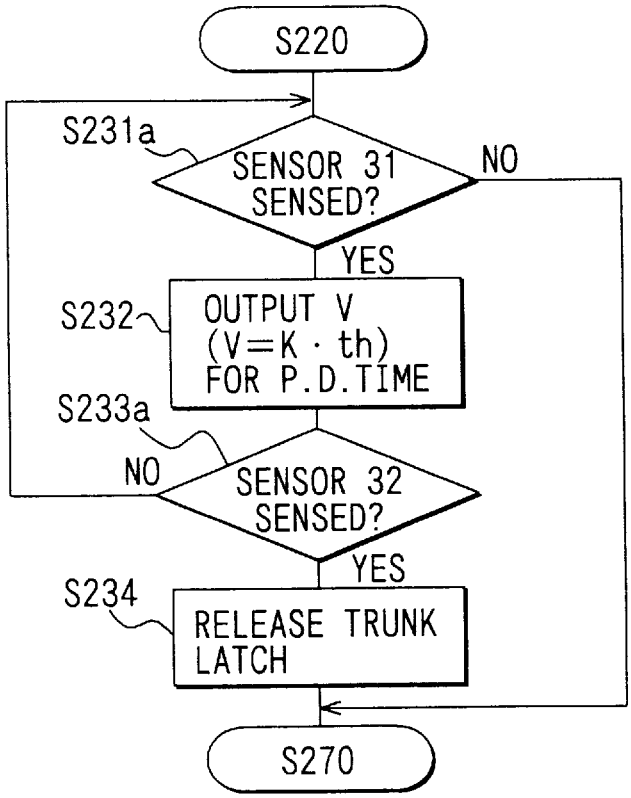
FIG. 8 is a flowchart illustrating a modified operation of the detection apparatus of the second embodiment.

Here, in FIG. 8, steps S231 and S233 in FIG. 7 are replaced with step S231*a* and S233*a*. At step S231*a*, the detection apparatus 40 detects whether the pyroelectric sensor 31 detects the temperature changes in the trunk 110 or not. At step S233*a*, the detection apparatus 40 detects whether the pyroelectric sensor 32 detects the temperature changes in the trunk 110 or not. Here, the sensitivity of the pyroelectric sensor 31 is set high compared to that of the pyroelectric sensor 32.

(Third embodiment)

In the first embodiment, the guidance lamp 60 is simply turned on when the detection apparatus 40 detects that operation condition, in which the locked-in detection in the trunk 110 is to be performed or not, is met. However, when the operation condition is met, the guidance lamp 60 may flash with a pattern which changes in response to the detection signal (detection sensor th) from the pyroelectric sensor 30. Operation of this embodiment will be explained with reference to FIG. 9.

Figure 9:
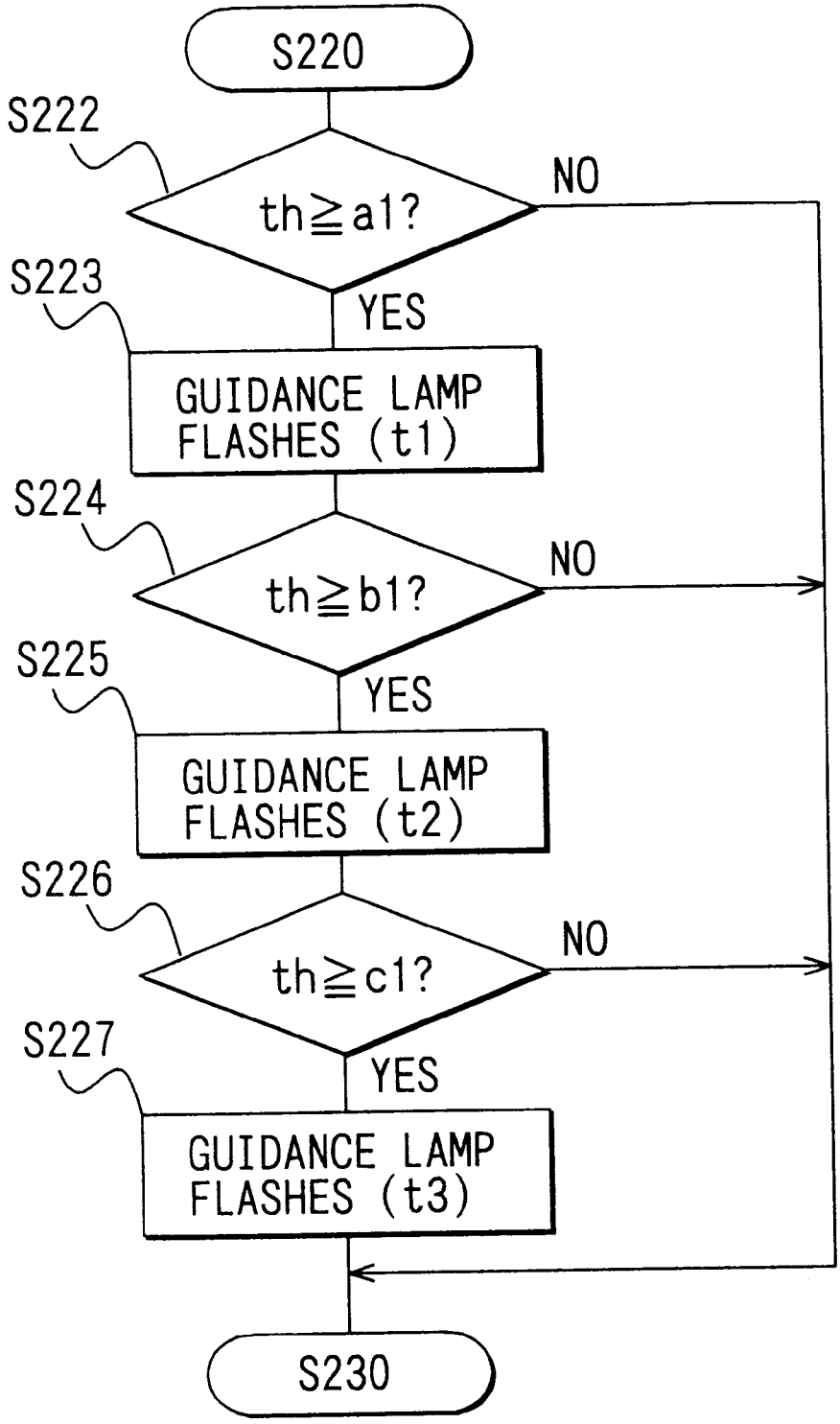
FIG. 9 is a flowchart illustrating an operation of a detection apparatus of a third embodiment according to the present invention.

In this embodiment, the step 220 in the flowchart in FIG. 3 is replaced with steps S222 to S227 in FIG. 9. The detection apparatus 40 performs a flashing process of the guidance lamp 60 in accordance with the flowchart shown in FIG. 9. Here, three thresholds a1, b1, c1 are used in the flashing process of the guidance lamp. The thresholds a1, b1, c1 are determined so that the sensitivity of the pyroelectric sensor 30 decreases in the order of threshold a1, b1, c1 (a1<b1<c1).

Hereinafter, operation of the detection apparatus 40 will be explained with reference to FIG. 9.

At first, the detection apparatus 40 judges whether the detection signal th from the pyroelectric sensor 30 is equal to or more than the threshold a1 or not (step S222). When the detection signal th from the pyroelectric sensor 30 is equal to or more than the threshold a1, the detection apparatus 40 moves to step S223 to control the guidance lamp 60 to flash at a flashing cycle t1.

Next, the detection apparatus 40 judges whether the detection signal th from the pyroelectric sensor 30 is equal to or more than the threshold b1 or not (step S224). When the detection signal th from the pyroelectric sensor 30 is equal to or more than the threshold b1, the detection apparatus 40 moves to step S225 to control the guidance lamp 60 to flash at a flashing cycle t2 which is shorter than the flashing cycle t1.

Next, the detection apparatus 40 judges whether the detection signal th from the pyroelectric sensor 30 is equal to or more than the threshold c1 or not (step S226). When the, detection signal th from the pyroelectric sensor 30 is equal to or more than the threshold c1, the detection apparatus 40 moves to step S227 to control the guidance lamp 60 to flash at a flashing cycle t3 which is shorter than the flashing cycle t2.

According to this structure, the sensitivity of the pyroelectric sensor 30 is changed in three steps, so that the flashing cycle of the guidance lamp 60 is changed in proportion to the sensitivity. Since the flashing cycle of the guidance lamp 60 is shortened as a distance between the guidance lamp 60 and the person's body is shortened, it can attract the attention of the person locked in the trunk 110 to the guidance lamp 60 without fail. Therefore, even when the person locked in the trunk 110 does not know an existence of the trunk locked-in person saving apparatus, this apparatus can guide a part of the person's body (e.g., hand) to the guidance lamp 60.

Here, similar to the first embodiment, the pyroelectric sensor 30 is arranged near the guidance lamp 60. Therefore, when the person locked in the trunk 110 approaches his/her body to the guidance lamp 60, he/she can approach the pyroelectric sensor 30. Hence, it can detect the person in the trunk 110 with the pyroelectric sensor 30.

In this embodiment, the flashing pattern of the guidance lamp 60 is changed in three steps depending on the detection signal th from the pyroelectric sensor 30. However, the flashing pattern may be changed in two, four or more steps. Furthermore, the flashing pattern of the guidance lamp 60 may be changed depending on a predetermined mathematical function.

In this embodiment, the guidance lamp 60 is used to guide the person locked in the trunk 110 to the pyroelectric sensor 30; however, a sound generator may be used instead. In this case, the sound generator is provided to the pyroelectric sensor 30 or near the pyroelectric sensor 30. The sound generator periodically generates sound, so that the period of the sound can be changed in proportion to the detection signal th from the pyroelectric sensor 30. Furthermore, loudness (or frequency) of the sound to be outputted from the sound generator may be changed depending on the detection signal th from the pyroelectric sensor 30.

(Fourth embodiment)

In the first embodiment, the latch condition of the trunk 110 is released when the detection apparatus 40 detects the person in the trunk 110. However, when the latch condition of the trunk 110 is released while the vehicle travels, it might be dangerous for the person in the trunk 110.

Therefore, when the detection apparatus 40 detects the person in the trunk 110 while the vehicle travels, the detection apparatus 40 turns on the warning lamp 50. It is preferable to air-condition the trunk 110 until the trunk 110 is opened by a driver or a passenger to minimize the hardship of the person locked in the trunk 110. A block diagram of an electric configuration of this case is shown in FIG. 10.

Figure 10:
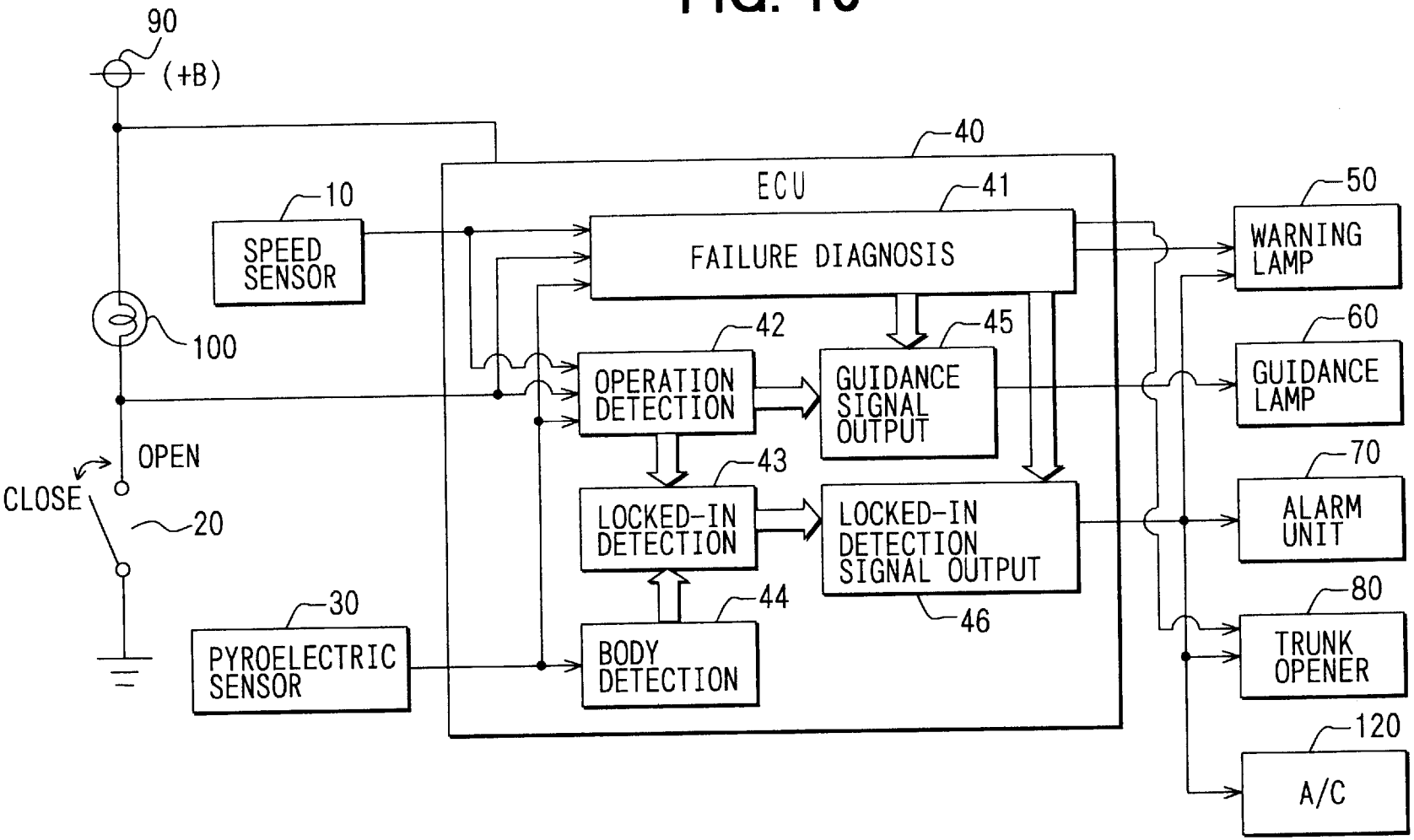
FIG. 10 is an electric block diagram illustrating a trunk locked-in person saving apparatus of a fourth embodiment according to the present invention.
Figure 11:
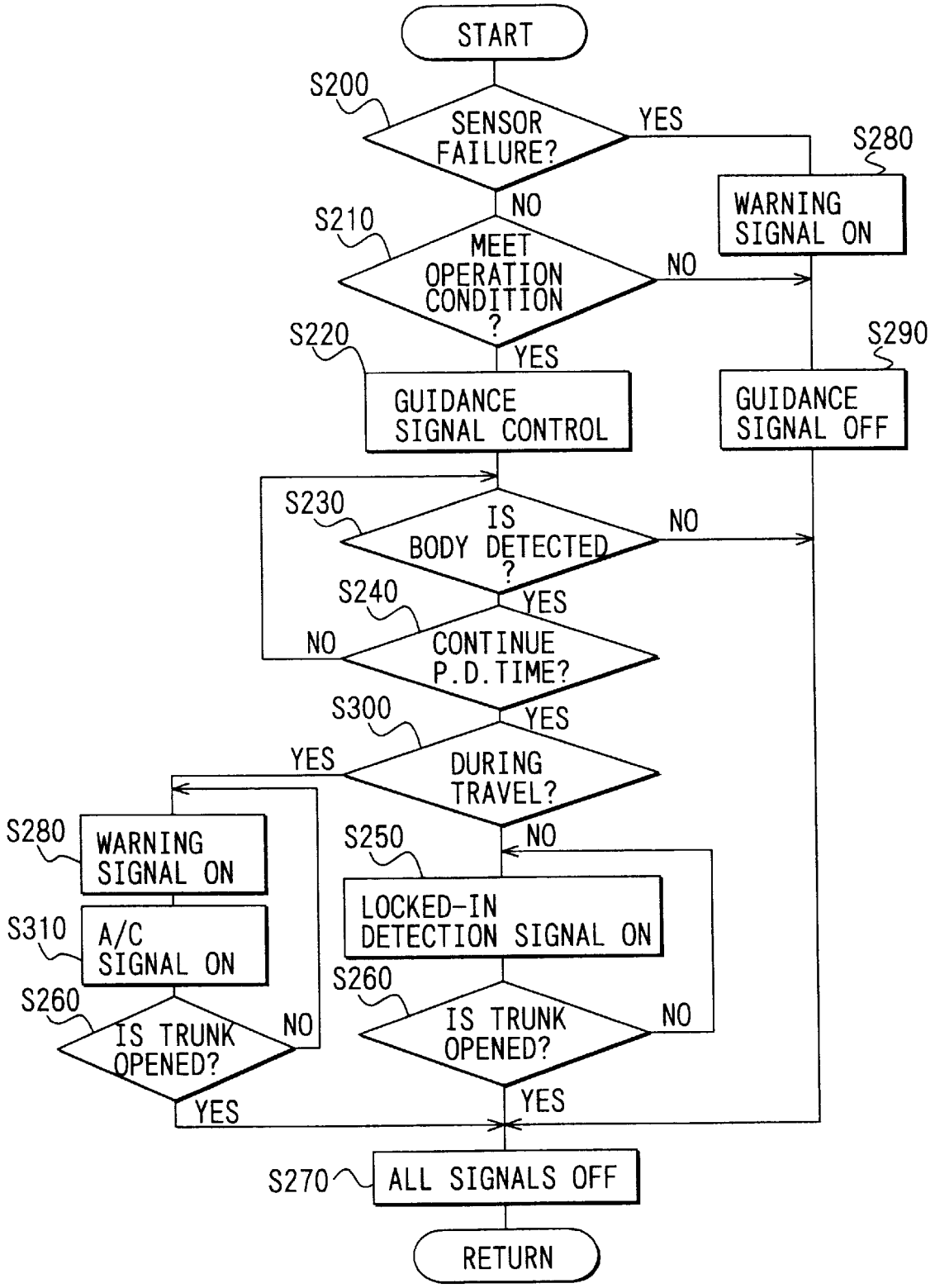
FIG. 11 is a flowchart illustrating an operation of a detection apparatus of the fourth embodiment.

FIG. 10 shows a structure in which an air-conditioner (A/C) 120 is added to an electric circuit structure shown in FIG. 3. The air-conditioner 120 is controlled by the detection apparatus 40 to perform the air-conditioning in the trunk 110. In this embodiment, a flowchart shown in FIG. 11 is employed instead of the flowchart shown in FIG. 3. Steps S200 to S290 in FIG. 11 are substantially the same as steps S200 to S290 in FIG. 3. The detection apparatus 40 performs processes based on the flowchart shown in FIG. 11.

Here, operation of the detection apparatus 40 will be explained with reference to FIG. 11.

At first, the detection apparatus 40 executes the processes of steps S200 to S240. After that, the detection apparatus 40 judges whether the vehicle is traveling or not based on detection signal from the vehicle speed sensor 10 (step S300). When the vehicle is traveling, the detection apparatus 40 moves to step S280 to output a warning output signal to the warning lamp 50 (step S280). Thus, the warning lamp 50 is turned on in response to the warning output signal. As a result, the detection apparatus 40 can inform the driver or passenger of the fact that a person is locked in the trunk 110.

Next, the detection apparatus 40 starts up and controls the air-conditioner 120 (step S310) to air-condition the trunk 110. After that, the detection apparatus 40 detects whether the trunk 110 is opened or not (step S260). When the trunk 110 is opened, the detection apparatus 40 terminates the operation of the air-conditioner 120 (step S270).

Thus, the trunk 110 can be air-conditioned by the air-conditioner 120 from a time the detection apparatus 40 detects that a person is locked in the trunk 110 to a time the trunk 110 is externally opened.

(Fifth embodiment)

In the first embodiment, when a pet (e.g., dog, cat) is loaded in the trunk 110, the detection apparatus 40 may detect the pet and may mistakenly open the trunk 110. Furthermore, it needs to prevent the detection apparatus 40 from falsely detecting when valuables are stored in the trunk 110.

In the first embodiment, when a pet (e.g., dog, cat) is loaded in the trunk 110, the detection apparatus 40 may detect the pet and may mistakenly open the trunk 110. Furthermore, it needs to prevent the detection apparatus 40 from falsely detecting when valuable thing is loaded in the trunk 110.

Figure 12:
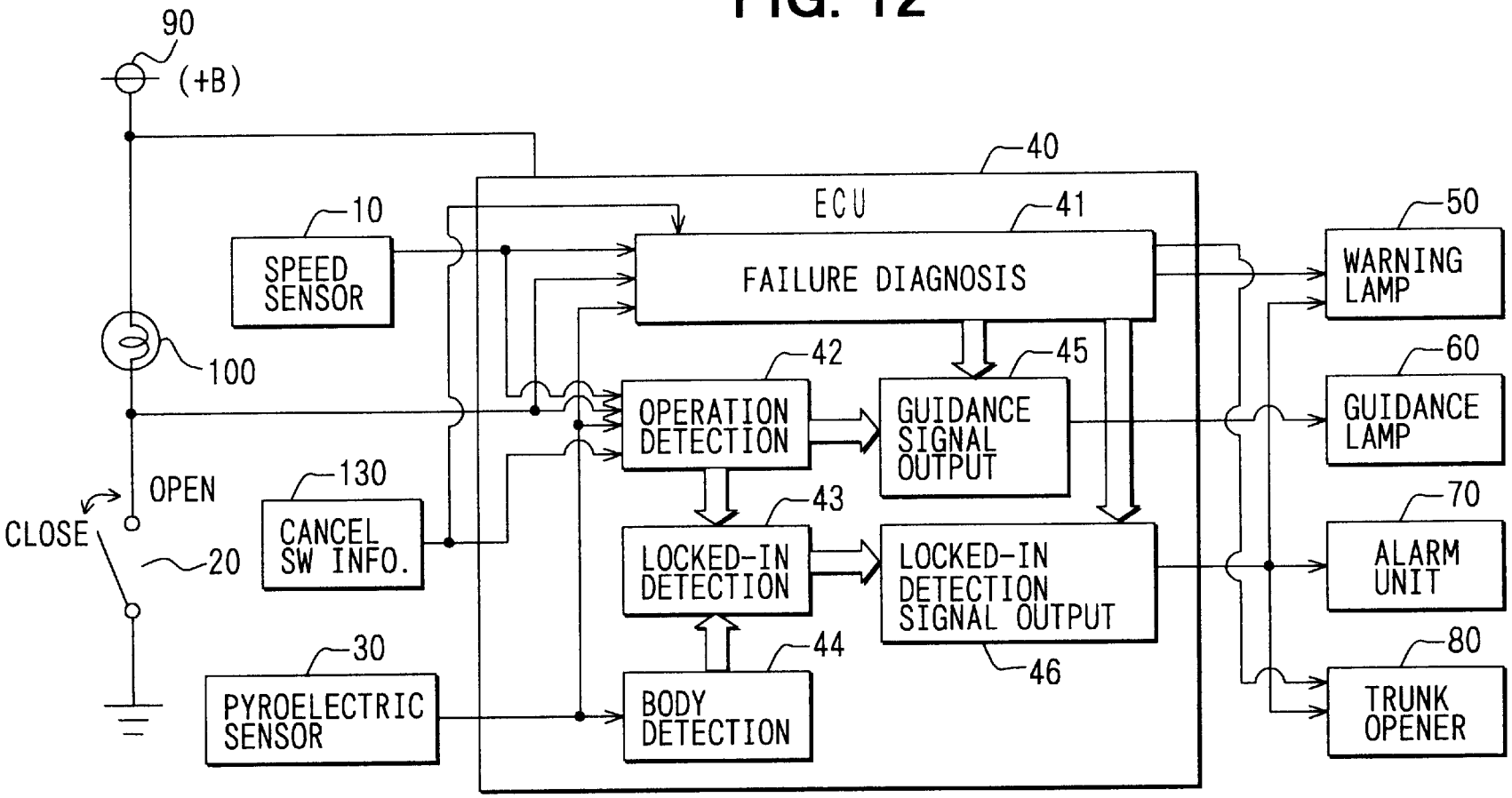
FIG. 12 is an electric block diagram illustrating a trunk locked-in person saving apparatus of a fifth embodiment according to the present invention.

In this fifth embodiment, a cancel switch 130 for prohibiting an execution of the saving process that saves the person locked in the trunk 110 is added. FIG. 12 shows a block diagram illustrating a structure including the cancel switch 130. FIG. 13 is a schematic diagram illustrating the cancel switch 130.

Figure 13A:
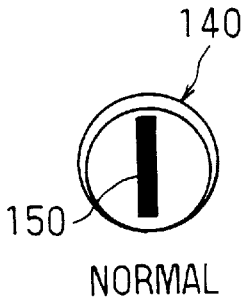
FIGS. 13A, 13B and 13C are schematic diagrams illustrating an operation of a cancel switch 130 shown in FIG. 12.
Figure 13B:
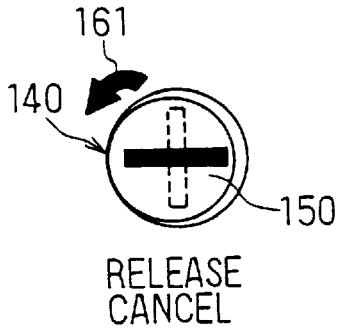

The cancel switch 130 is operated by an operator, and outputs cancel signal for prohibiting the executing of the saving process to the detection apparatus 40. As shown in FIGS. 13A and 13B, the cancel switch 130 is operated by an operation of a lock cylinder 140 with a key 150.

Figure 13C:
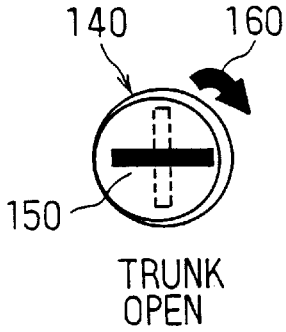

In detail, while the trunk 110 is closed, when the key 150 is rotated to a left direction as shown by an arrow 161 from a vertical position to a horizontal position, as shown in FIGS. 13A and 13B, the cancel switch 130 is turned on and outputs the cancel signal to the detection apparatus 40. Here, while the trunk 110 is closed, when the key 150 is rotated to a right direction as shown by an arrow 160 from a vertical position to a horizontal position, as shown in FIGS. 13A and 13C, the latch release condition is activated.

Figure 14:
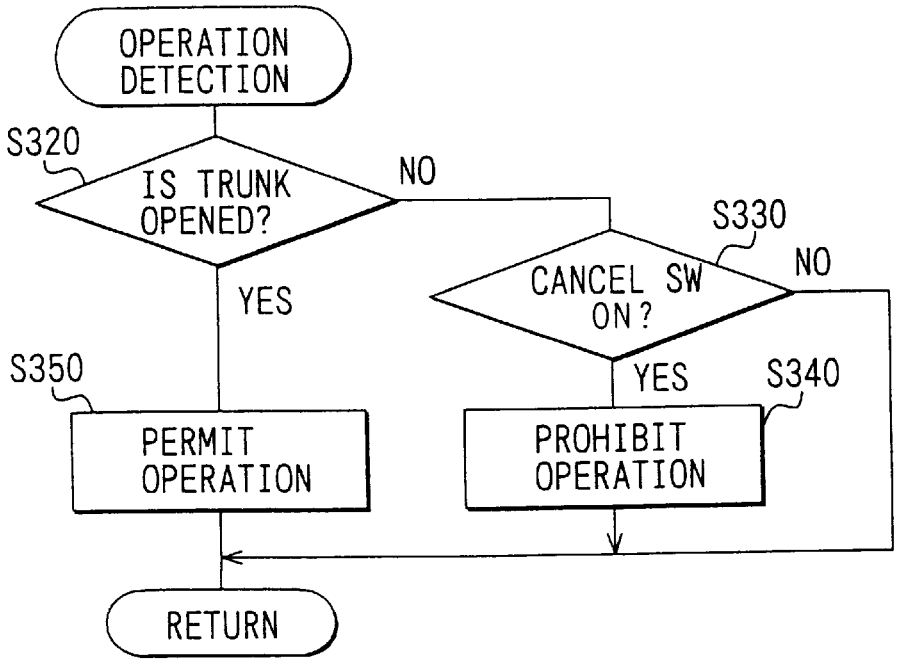
FIG. 14 is a flowchart illustrating an operation of a detection apparatus of the fifth embodiment.

Hereinafter, the operation of the detection apparatus 40 will be explained with reference to FIG. 14. The detection apparatus 40 executes processes based on a flowchart shown in FIG. 14.

At first, the detection apparatus 40 detects whether the trunk 110 is opened in response to the trunk open/close switch signal from the trunk open/close switch 20 or not (step S320). When the trunk 110 is opened, the detection apparatus moves to step S330.

Next, the detection apparatus 40 detects whether the cancel signal is outputted from the cancel switch 130 (step S330). When the cancel signal is outputted from the cancel switch 130, the detection apparatus 40 prohibits the execution of the saving process. Here, when the trunk 110 is opened at step S320, the detection apparatus 40 moves to step S350 to permit the execution of the saving process, and further executes the process described in FIG. 3.

In this embodiment, the cancel switch 130 is operated as a result of external key operation for the lock cylinder 140 of the trunk 110. However, the cancel signal 130 can be operated in response to the operation via a keyless entry system (electric key system).

Furthermore, the cancel switch 130 may be provided in a passenger component, so that the passenger (driver) can operate the cancel switch 130.

In this embodiment, the cancel switch 130 is operated while the trunk 110 is closed. However, the cancel switch 130 may be operated while the trunk 110 is opened.

In detail, the cancel switch 130 is designed so that the cancel switch 130 outputs the cancel switch to the detection apparatus 40 when the trunk 110 is opened and after that the trunk 110 is closed with pulling a knob of the trunk 110.

Figure 15:
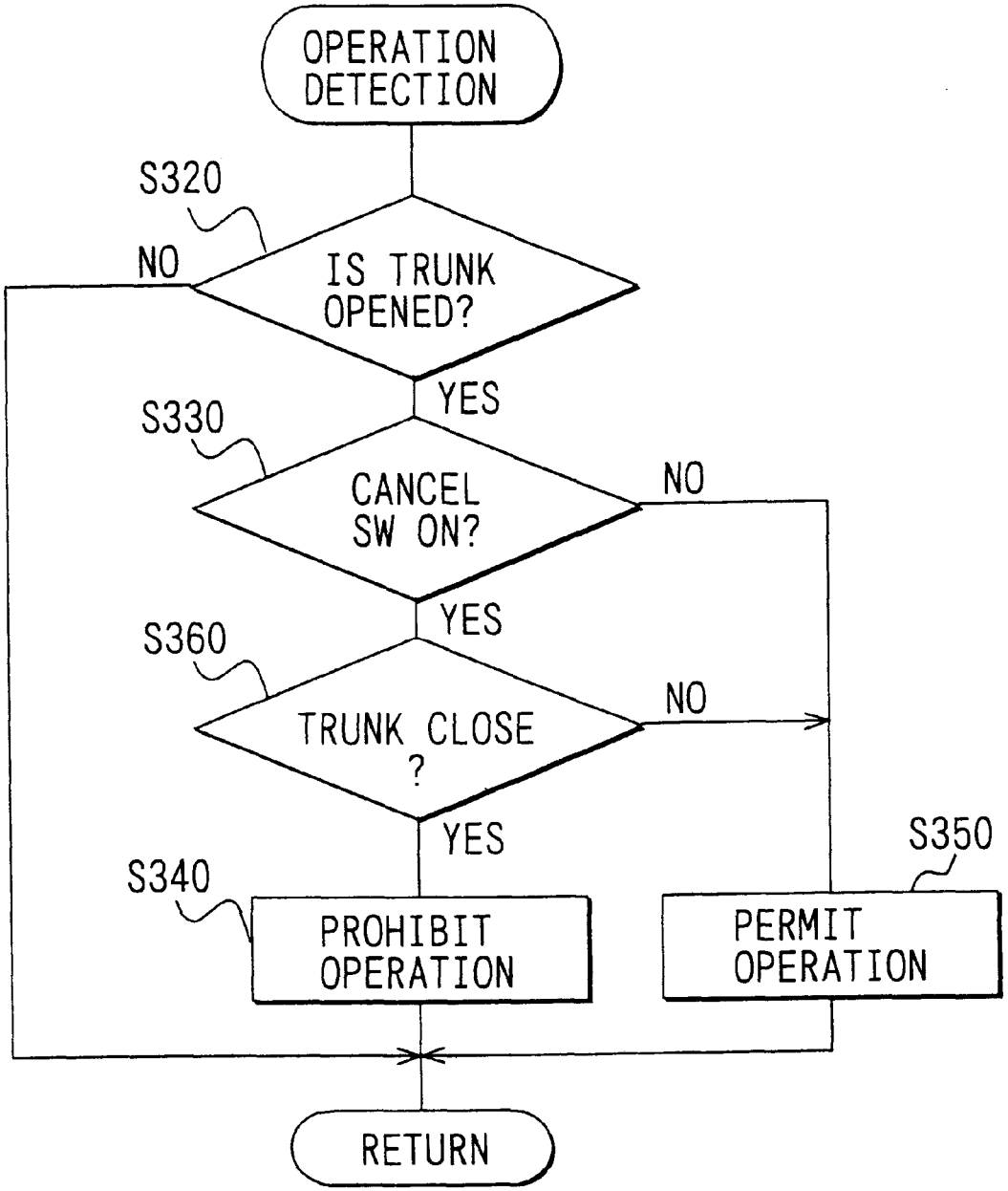
FIG. 15 is a flowchart illustrating a modified operation of the detection apparatus of the fifth embodiment.

Referring to FIG. 15, at first, the detection apparatus 40 detects whether the trunk 110 is opened or not (step S320). When the trunk 110 is opened, the detection apparatus 40 moves to step S330. At step S330, the detection apparatus 40 detects whether the cancel signal is outputted from the cancel switch 130 or not (step S330).

When the cancel signal is outputted from the cancel switch 130 at step S330, the detection apparatus 40 moves to step S360. At step S360, the detection apparatus 40 detects whether the trunk 110 is closed or not. When the trunk 110 is opened, the detection apparatus 40 prohibits execution of the saving process. On the contrary, when the cancel switch is not outputted from the cancel switch 130 at step S330, the detection apparatus 40 moves to step S350 to permit the execution of the saving process, and performs the processes shown in FIG. 3.

Furthermore, the cancel switch 130 to be operated while the trunk 110 is closed may be operated in response to a turning-on operation of the ignition switch. Moreover, the cancel switch 130 may be provided in the trunk 110.

(Sixth embodiment)

Figure 16:
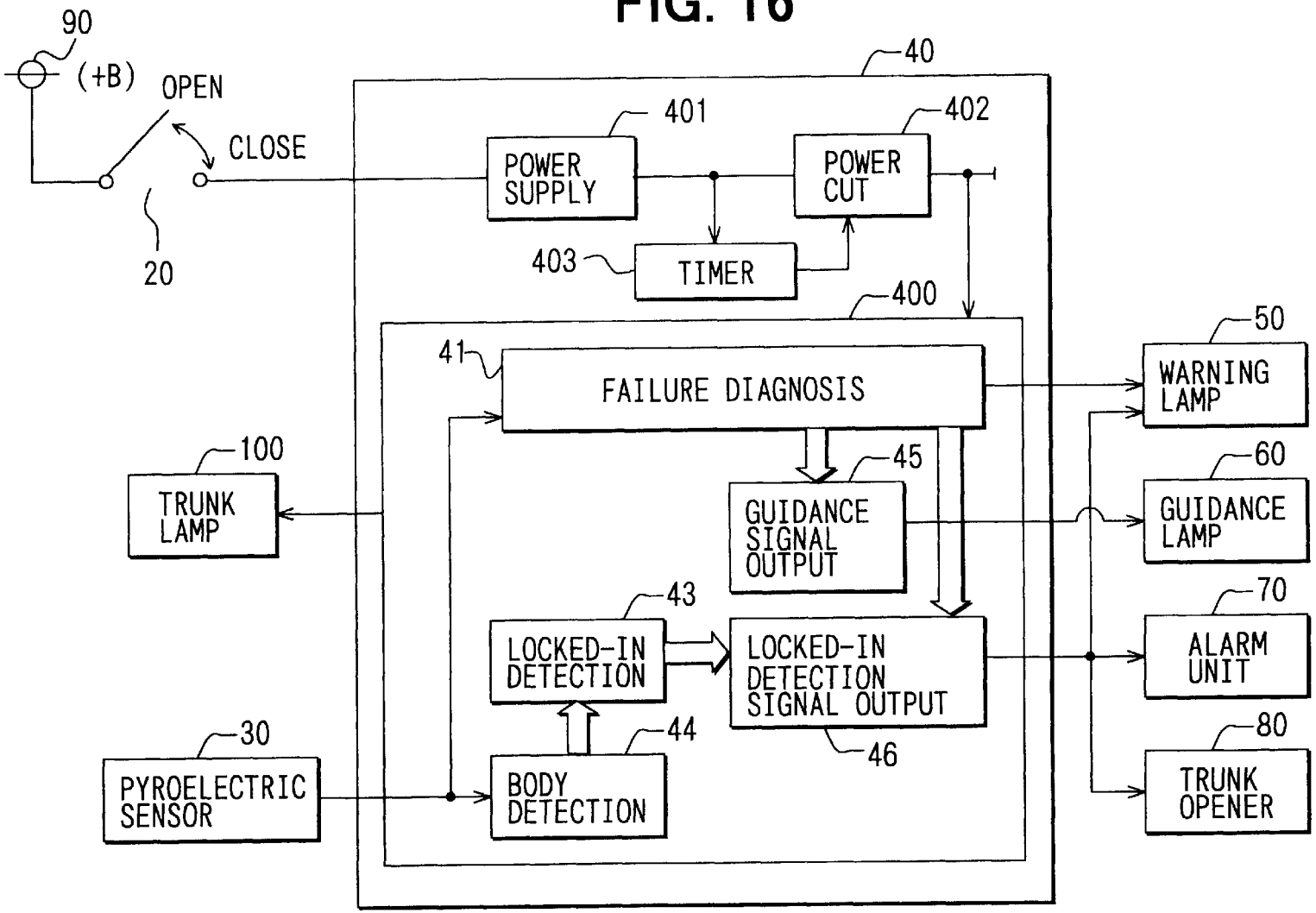
FIG. 16 is an electric block diagram illustrating a trunk locked-in person saving apparatus of a sixth embodiment according to the present invention.

As shown in FIG. 16, the trunk locked-in person saving apparatus is provided with a truck open/close switch 20, a pyroelectric sensor 30, a detection apparatus (ECU) 40, a warning lamp 50, a guidance lamp 60, an alarm unit 70 and a trunk opener 80. The trunk open/close switch 20 is connected between the detection device 40 and a battery (+B) 90. The trunk open/close switch is turned on when a trunk (trunk lid) is closed, and is turned off when the trunk is open.

The detection apparatus 40 is provided with a power supply circuit 401, a power-cut circuit 402, a timer circuit 403 and a control circuit 400. The power supply circuit 401 is connected between the trunk open/close switch 20 and the control circuit 400, and outputs regulated voltage to the timer circuit 403 and the control circuit 400. Here, the regulated voltage is supplied from the battery 90 via the trunk open/close switch 20.

The power-cut circuit 402 is connected between the power supply circuit 401 and the control circuit 400 to connect or disconnect between the power supply circuit 401 and the control circuit 400. The timer circuit 403 controls the power-cut circuit 402 to connect between the power supply circuit 401 and the control circuit 400 only for a predetermined time after the timer receives the regulated voltage from the power supply circuit 401. As a result, the control circuit 400 can receive the regulated voltage only for the predetermined time after the timer receives the regulated voltage from the power supply circuit 401.

The control circuit 400 is provided with a failure diagnosis portion 41, a locked-in detection portion 43, a body detection portion 44, a guidance signal output portion 45 and a locked-in detection signal output portion 46. The detection apparatus 40 executes a locked-in person saving process for saving the person who is locked in the trunk 110. Here, the failure diagnosis portion 41 detects a failure of the pyroelectric sensor 30. The locked-in detection portion 43 judges whether a person is locked in the trunk 110 or not. The body detection portion 44 detects an existence of a person in the trunk 110. The guidance signal output portion 45 turns on the guidance lamp 60 in response to decisions of the failure diagnosis portion 41 and the operation detection portion 42. The locked-in detection signal output portion 46 controls the warning lamp 50, the alarm unit 70 and the trunk opener 80 in response to the decisions of the failure diagnosis portion 41 and the locked-in detection portion 43. The control circuit 400 is made up of a microcomputer or the like. Operation of the control circuit 400 will be described later.

The pyroelectric sensor 30 outputs a detection signal in response to temperature changes per a unit time (an amount of change of received infrared ray) in the trunk. As a result, the pyroelectric sensor 30 detects movements of object having a predetermined temperature in the trunk, and outputs the detection signal to the control circuit 400. In other words, the pyroelectric sensor 30 senses behavior of a person who is locked in the trunk. The warning lamp 50 is a display panel provided near an instrument panel of the vehicle, and is controlled by the detection apparatus 40. The warning lamp 50 is for alarming the fact that a person is locked in the trunk 110.

The guidance lamp 60 is made up of a light emitting diode provided near the pyroelectric sensor 30, and is controlled by the detection apparatus 40, so that the guidance lamp 60 guides the person locked in the trunk toward the pyroelectric sensor 30. Here, the guidance lamp 60 has an infrared ray shield filter. As a result, the detection signal from the pyroelectric sensor 30 is not influenced by emitting light from the guidance lamp 60.

The alarm unit 70 is controlled by the detection apparatus 40, and outputs an alarm by way of sound. The trunk opener (latch release mechanism) 80 is actuated by the detection apparatus 40 to release a latch condition of the trunk 110. The trunk lighting lamp 100 is positioned near the pyroelectric sensor 30, and is used for a failure detection of the pyroelectric sensor 30, as described later. Here, the warning lamp 50, the alarm unit 70 and the trunk opener 80 are operated for saving the person in the trunk 110.

Figure 17:
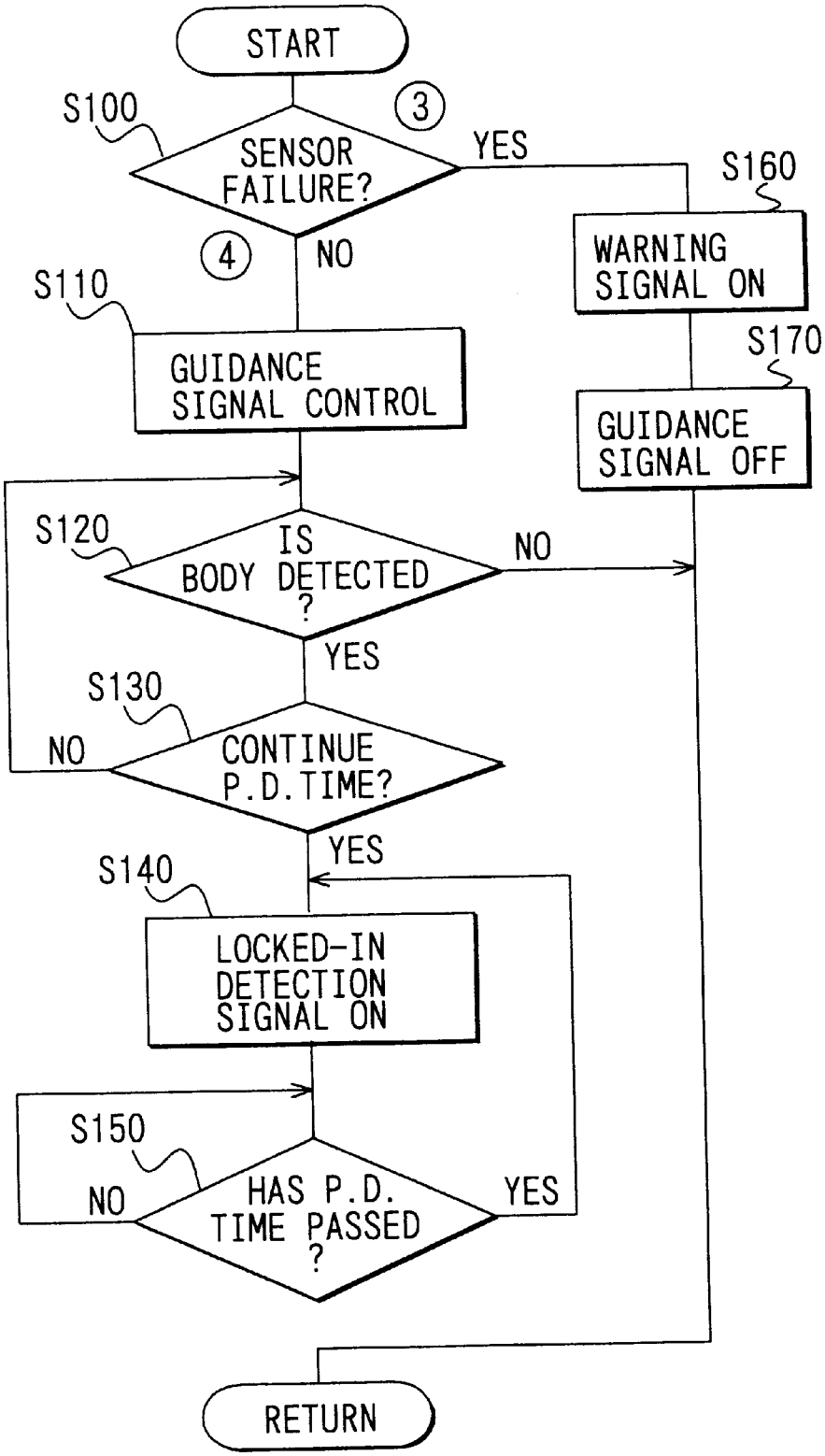
FIG. 17 is a flowchart illustrating an operation of a detection apparatus of the sixth embodiment.
Figure 18:
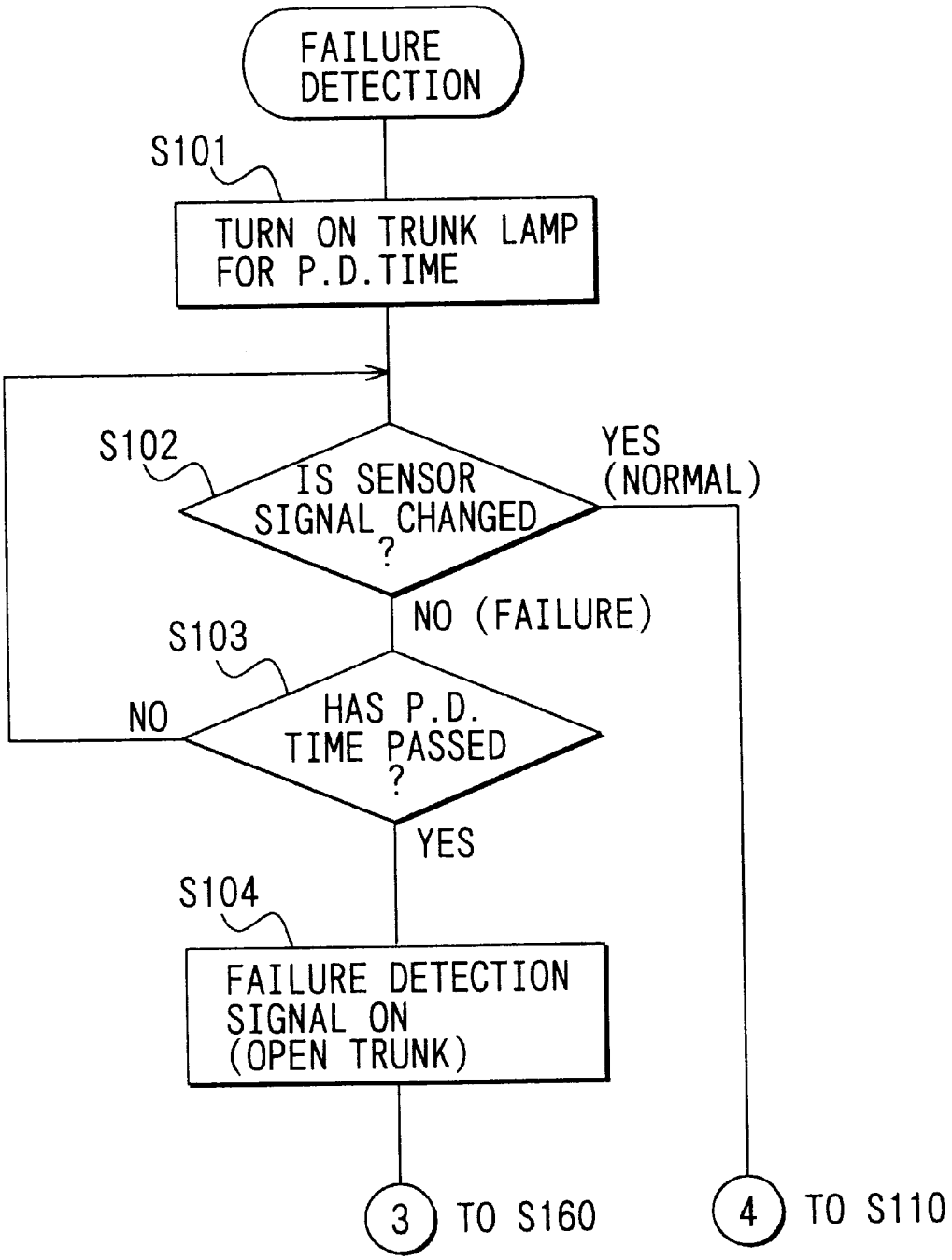
FIG. 18 is a flowchart illustrating a failure detection step S100 in FIG. 17 in detail.

Hereinafter, processes of the detection apparatus 40 (process for saving the person locked in the trunk 110) will be explained with reference to FIGS. 17 and 18. The detection apparatus 40 performs these processes based on a flowchart shown in FIG. 17.

At first, the detection apparatus 40 judges whether the pyroelectric sensor 30 is in a failure condition (out of order) or not (step S100). In detail, as shown in FIG. 18, the detection apparatus 40 turns on the trunk lighting lamp 100 for a predetermined time (step S101), and detects whether outputs of the pyroelectric sensor 30 has changed or not (step S102). Here, when the trunk lighting lamp 100 is turned on, and when the pyroelectric sensor 30 is normal, the detection signal from the pyroelectric sensor 30 changes in response to the turning on of the trunk lighting lamp 100. The detection apparatus 40 can detect whether the pyroelectric sensor is in the failure condition or not by detecting whether the detection signal from the pyroelectric sensor has changed or not.

Next, the detection apparatus 40 detects whether a predetermined time has passed or not (step S103). When the detection signal from the pyroelectric sensor 30 has not changed within the predetermined time, the detection apparatus 40 determines that the pyroelectric sensor 30 is in the failure condition, and outputs a failure detection signal to the trunk opener 80, as shown in FIG. 17 (step S160).

Therefore, the trunk opener 80 releases the latch release condition when the failure detection signal is received. After that, the guidance lamp 60 is turned off (step S170).

Incidentally, when the detection signal from the pyroelectric sensor 30 has changed at step S100, the detection apparatus 40 determines that the pyroelectric sensor 30 is normal. Then, the detection apparatus 40 moves to step S110 to turn on the guidance lamp 60 (step S110). Thus, when the person is locked in the trunk 110, a shown in FIG. 6, the guidance lamp 60 attracts attention of the person, and then the person approaches a part of his/her body (e.g., a hand) to the guidance lamp 60 and the pyroelectric sensor 30. As a result, person's movement is partly detected by the pyroelectric sensor 30.

Next, the detection apparatus 40 compares the detection signal from the pyroelectric sensor 30 with a threshold value (step S120). When the detection signal from the pyroelectric sensor 30 is equal to or more than the threshold value (detection signal>threshold value), the detection apparatus moves to step S130 to detect whether a condition, in which the detection signal from the pyroelectric sensor 30 is larger than the threshold value, continues for a predetermined time or not. Here, when the condition continues for the predetermined time, the detection apparatus 40 determines that a person is locked in the trunk 110, and the detection apparatus 40 moves to step S140 to output a locked-in detection signal to the warning lamp 50, the alarm unit 70 and the trunk opener 80.

Therefore, the warning lamp 50 is turned on when it receives the locked-in detection signal. The alarm unit 70 outputs alarm by way of sound when it receives the locked-in detection signal. The trunk opener releases the latch condition of the trunk 110 when it receives the locked-in detection signal. After the latch condition of the trunk 110 is released, the power supply from the battery is opened (being cut), and this routine is terminated. When the latch of the trunk 110 is not released, the detection apparatus 40 returns to step S140 after a predetermined time, for example, two seconds has passed.

Next, supply of the power to the control circuit 400 in the detection apparatus 40 will be explained. At first, when the trunk 110 is opened, the trunk open/close switch 20 is turned on, and the power is supplied to the detection apparatus 40 from the battery 80 via the trunk open/close switch 20.

Here, the power supply circuit 401 is powered by the battery 90 via the trunk open/close switch 20, and outputs the regulated voltage to the power-cut circuit 402 and the timer circuit 403. Therefore, the timer circuit 403 keeps on connecting between the power supply circuit 401 and the control circuit 400 for only a predetermined time after the timer receives the regulated voltage by using the power-cut circuit 402.

Therefore, the control circuit 400 receives the regulated voltage from the power supply circuit 401 only for the predetermined time after the regulated voltage from the power supply circuit 401 is received. As a result, the control circuit 400 starts the saving process for saving a person who is accidentally locked in the trunk by receiving the regulated voltage from the power supply 401, and terminates the saving process after a predetermined time has passed.

According to the structure in the above, the saving process to be executed by the control circuit 400 is started or stopped in response to the start or stop of the power supply to the control circuit 400, instead of the structure shown in FIG. 4 in which the saving process is controlled based on the trunk open/close signal from the trunk lighting lamp. Therefore, it does not need a harness for transmitting the trunk open/close signal from the trunk lighting lamp 100, and it can reduce the number of the harnesses.

Here, the detection apparatus 40 may be made up of a microcomputer having a sleep function. In this case, the microcomputer may perform the saving process only for a predetermined time after the trunk is closed by using this sleep function. For example, the microcomputer contains a built-in processing circuit. The built-in processing circuit is powered for only the predetermined period by the timer operation of the built-in timer of the microcomputer. After that, power supply to the built-in processing circuit is terminated.

What is claimed is:

1. A locked-in person saving apparatus comprising:

a detector for detecting whether a person is locked in a trunk of a vehicle;

a trunk controller for outputting a latch release signal when the detector detects that a person is locked in the trunk; and a latch releaser for releasing a latch condition of the trunk in response to the latch release signal from the trunk controller.

2. A locked-in person saving apparatus according to claim 1, wherein the trunk controller prohibits releasing the latch condition with the latch releaser, when the vehicle is traveling.

3. A locked-in person saving apparatus according to claim 1, further comprising:

a body detection sensor for detecting a person's body in the trunk and for outputting a detection signal;

an alarm unit for outputting an alarm; and a first alarm controller for controlling the alarm unit so that the alarm unit outputs the alarm substantially simultaneously with outputting of the latch release signal from the trunk controller in response to the detection signal outputted from the body detection sensor, wherein the detector detects whether a person is locked in the trunk of the vehicle in response to the detection signal outputted from the body detection sensor.

4. A locked-in person saving apparatus according to claim 1, further comprising:

a body detection sensor for detecting a person's body in the trunk and for outputting a detection signal, wherein the detector detects whether a person is locked in the trunk of the vehicle in response to the detection signal outputted from the body detection sensor;

an alarm unit for outputting an alarm; and a first alarm controller for controlling the alarm unit so that the alarm unit outputs the alarm before outputting of the latch release signal from the trunk controller in response to the detection signal outputted from the body detection sensor.

5. A locked-in person saving apparatus according to claim 1, further comprising:

an air conditioner for conditioning air in the trunk;

an air conditioner controller for controlling the air conditioner to condition the air in the trunk when the detector detects that a person is locked in the trunk while the vehicle is traveling.

6. A locked-in person saving apparatus according to claim 1, wherein the detector detects whether a person is locked in the trunk of the vehicle during a predetermined time from a time when the trunk is closed.

7. A locked-in person saving apparatus according to claim 3, wherein the detector detects whether a person is locked in the trunk of the vehicle based on the detection signal which is continuously outputted from the body detection sensor for a predetermined time.

8. A locked-in person saving apparatus according to claim 3, wherein the detector detects whether a person is locked in the trunk of the vehicle by comparing the detection signal from the body detection sensor with at least two threshold values, and each of the threshold values has a different value from each other.

9. A locked-in person saving apparatus according to claim 1, further comprising:

an out-of-order detector for detecting whether the body detection sensor is out of order or not based on the detection signal from the body detection sensor;

a warning unit for outputting a warning to a passenger in the vehicle;

a warning controller for controlling the warning unit to output the warning when the out-of-order detector detects that the body detection sensor is out of order.

10. A locked-in person saving apparatus according to claim 1, further comprising:

a body detection sensor for detecting a person's body in the trunk and for outputting a detection signal, wherein the detector detects whether a person is locked in the trunk of the vehicle in response to the detection signal outputted from the body detection sensor;

an out-of-order detector for detecting whether the body detection sensor is out of order or not based on the detection signal from the body detection sensor;

a latch controller (S204) for prohibiting the trunk from becoming the latch condition when the out-of-order detector detects that the body detection sensor is out of order.

11. A locked-in person saving apparatus according to claim 9, wherein:

the body detection sensor includes a photoelectric sensor for outputting the detection signal in response to incident light; and the out-of-order detector detects whether the body detection sensor is out of order or not based on the detection signal from the body detection sensor when the trunk is opened.

12. A locked-in person saving apparatus according to claim 11, further comprising:

a lighting unit for lighting inside of the trunk when the trunk is opened, wherein the body detection sensor outputs the detection signal when the body detection sensor receives light from the lighting unit; and the out-of-order detector detects whether the body detection sensor is out of order or not based on the light outputted from the lighting unit.

13. A locked-in person saving apparatus according to claim 3, further comprising a guidance unit for guiding the person locked in the trunk toward the body detection sensor.

14. A locked-in person saving apparatus according to claim 13, further comprising a guidance controller for controlling the guidance unit so that a pattern of guidance is changed in response to a distance between the person locked in the trunk and the body detection sensor.

15. A locked-in person saving apparatus according to claim 1, further comprising a lighting unit provided near the body detection sensor, for lighting inside of the trunk when the trunk is opened, the lighting unit is controlled so as to guide the person locked in the trunk toward the body detection sensor.

16. A locked-in person saving apparatus according to claim 1, further comprising a detector controller for prohibiting the detector from detecting whether a person is locked in the trunk.

17. A locked-in person saving apparatus according to claim 16, wherein the detector controller prohibits the detector from detecting, in response to an operation to a lock cylinder of the trunk.

18. A locked-in person saving apparatus according to claim 16, wherein the detector controller prohibits the detector from detecting, in response to an operation of a knob of the trunk.

19. A locked-in person saving apparatus according to claim 1, wherein the body detection sensor is positioned on an upper wall in the front of a trunk lid of the trunk.

20. A locked-in person saving apparatus comprising:

an operation controller for outputting a signal for saving a person locked in a trunk of a vehicle;

a trunk open/close switch connected between a power source and the operation controller, the trunk open/close switch being turned on when the trunk is closed and being turned off when the trunk is opened; and a power supply unit for supplying a power from the power source to the operation controller through the trunk open/close switch only for a predetermined time after the trunk is closed.

21. A locked-in person saving apparatus according to claim 20, wherein the power supply unit includes:

a power supply switch for connecting or disconnecting between the trunk open/close switch and the operation controller, so that the power from the power source to the operation controller through the trunk open/close switch is started or stopped; and a switch controller for controlling the power supply switch, so as to supply the power from the power source to the operation controller through the trunk open/close switch only for a predetermined time after the trunk is closed.

22. A locked-in person saving apparatus according to claim 21, wherein the switch controller includes:

a voltage output unit provided between the trunk open/close switch and the power supply switch, for receiving the power from the power source through the trunk open/close switch, and for outputting a predetermined voltage to the operation controller; and a power supply controller for controlling the voltage output unit to output the predetermined voltage to the operation controller through the power supply switch only for a predetermined time after the predetermined voltage is outputted from the voltage output unit.

* * * * *